United States Patent [19]

Love

[11] 4,080,939

[45] Mar. 28, 1978

[54] TIMING CONTROL APPARATUS FOR A COMBUSTION ENGINE

[76] Inventor: Bobby J. C. Love, 2585 Hatfield Cir., SE., Atlanta, Ga. 30316

[21] Appl. No.: 668,866

[22] Filed: Mar. 22, 1976

[51] Int. Cl.[2] ..... F02P 5/04

[52] U.S. Cl. ..... 123/117 R; 318/640; 318/676; 73/518

[58] Field of Search ..... 123/117 R, 146.5 A, 123/102, 117 A; 324/164, 166, 175; 318/640, 676; 73/517 B, 518

[56] References Cited

U.S. PATENT DOCUMENTS

| | | | |
|---|---|---|---|
| 2,164,114 | 6/1939 | Kolb | 123/102 |
| 2,167,484 | 7/1939 | Berry | 318/640 |
| 3,068,953 | 12/1962 | Petersen | 123/102 |
| 3,490,295 | 1/1970 | Westby et al. | 73/518 |
| 3,717,803 | 2/1973 | Sweger | 318/676 |
| 3,785,356 | 1/1974 | Niemoeller | 123/117 A |
| 3,824,972 | 7/1974 | Sattler | 123/117 A |

*Primary Examiner*—Charles J. Myhre
*Assistant Examiner*—Andrew M. Dolinar
*Attorney, Agent, or Firm*—James B. Middleton

[57] ABSTRACT

Timing control apparatus for varying the ignition timing of a combustion engine in response to changes in engine r.p.m. including a meter having a hand, a gate carried at the end of the hand for blocking one of two light beams on movement of the hand, circuit means responsive to blocking of a light beam for energizing a servo motor, and mechanical means driven by the servo motor for both varying the engine timing and rotating the light beam so that the light beam is no longer blocked.

5 Claims, 6 Drawing Figures

Fig. 1
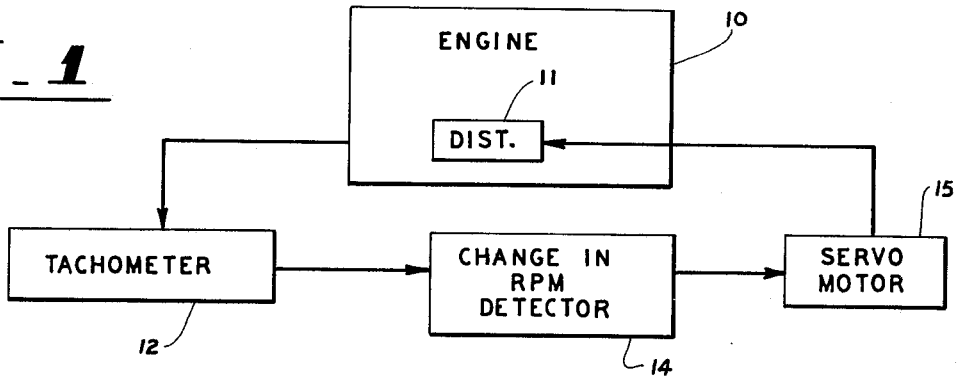
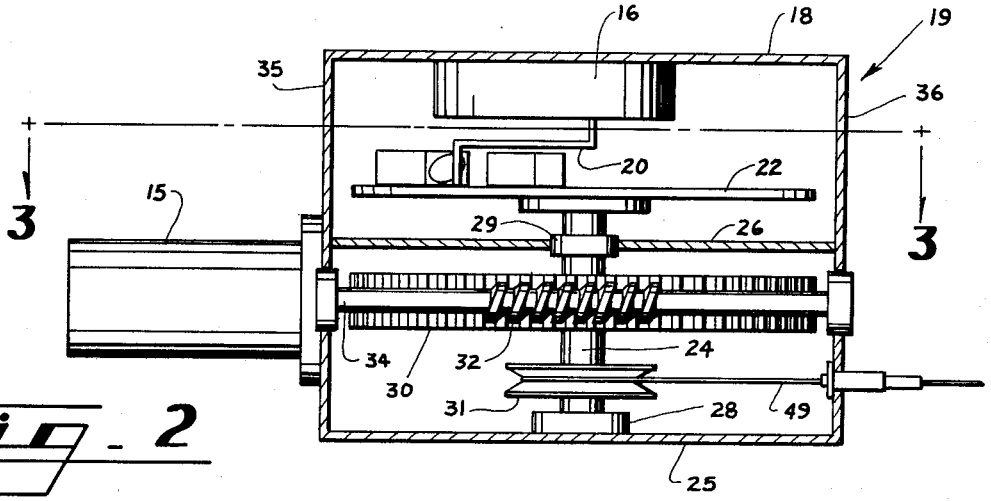
Fig. 2
Fig. 3
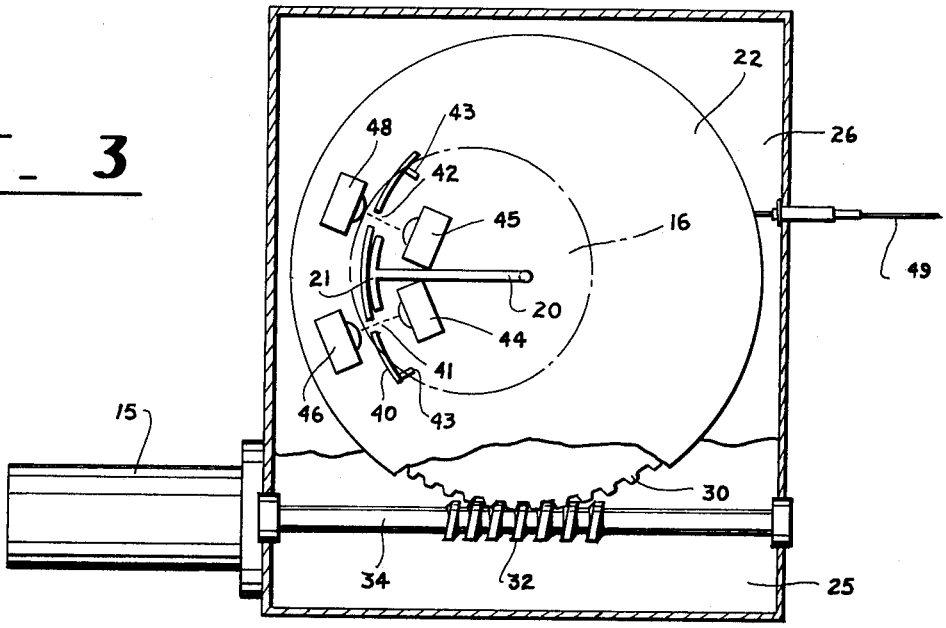

TIMING CONTROL APPARATUS FOR A COMBUSTION ENGINE

This invention relates generally to control means for internal combustion engines, and is more particularly concerned with means for adjusting the ignition timing of an engine in response to changes in the speed of an engine.

It is well known that, in operating an internal combustion engine, the timing of ignition of a combustible mixture within a cylinder is important to efficient operation of the engine, and the timing must be varied in accordance with the speed at which the engine is operating.

Numerous forms of apparatus have been provided for varying the ignition timing in accordance with variations in engine speed, but most of the prior art apparatus utilizes elaborate electronics which are not easily adaptable to conventional ignition systems. The most commonly used means for varying the ignition timing in accordance with engine speed comprises a centrifugally operated mechanical apparatus within the distributor whereby the cam for operating the points is rotated relative to the points. The cam is rotated in one direction as the speed of the distributor drive shaft is increased and is rotated in the opposite direction as the speed is decreased. It will be understood by those skilled in the art that such a mechanical apparatus, being generally dependent on spring tension and other such difficult to adjust variables is neither highly accurate nor highly reliable.

The present invention overcomes the above mentioned and other difficulties with the prior art by providing a tachometer for indicating engine speed, and means operative in response to variations of the tachometer for varying the timing of an engine.

More particularly, the apparatus of the present invention includes a pair of light beams, one of which will be interrupted when the meter of the tachometer reflects a different rotational speed; and, circuit means responsive to the interruption of the light beam automatically causes appropriate variation in the ignition timing and resets the tachometer so the tachometer can reflect a subsequent change in engine speed.

These and other features and advantages of the present invention will become apparent from consideration of the following specification when taken in conjunction with the accompanying drawing in which:

FIG. 1 is a schematic diagram illustrating the general system of the present invention;

FIG. 2 is an elevational view of a meter and servo unit made in accordance with the present invention, the cover being removed to show the internal structure;

FIG. 3 is a cross-sectional view taken substantially along the line 3—3 in FIG. 2;

Figure 4:
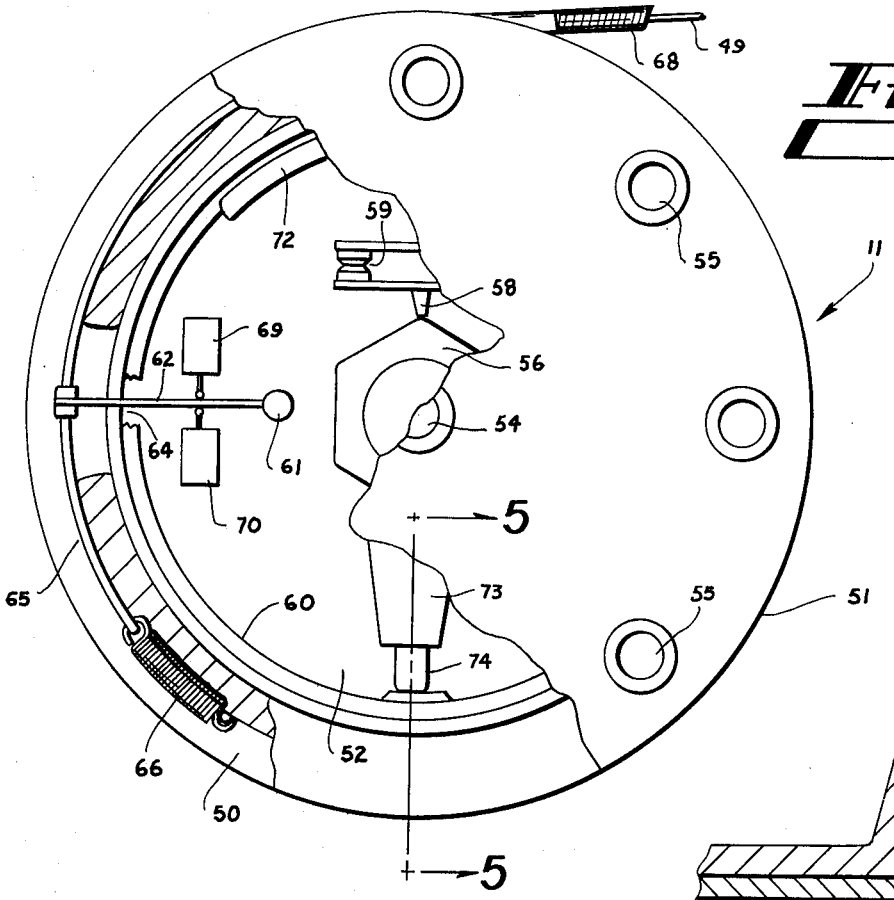
FIG. 4 is a top plan view of a distributor made in accordance with the present invention, the device being partially in cross-section to show the structure.
Figure 5:
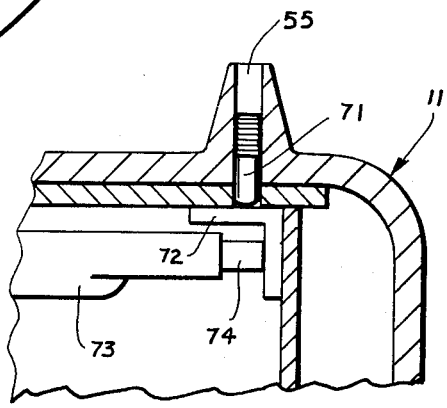
FIG. 5 is a fragmentary cross-sectional view taken substantially along the line 5—5 in FIG. 4; and, FIG. 6 is a schematic circuit diagram illustrating a control circuit for the present invention.

Referring now more particularly to the drawings and to that embodiment of the invention here chosen by way of illustration, it will be seen in FIG. 1 that there is an engine 10 having a distributor 11.

It should here be understood that the principle involved in the present invention is applicable to internal combustion gasoline engines using a spark ignition and to engines of the diesel type utilizing residual heat for ignition. In both cases, timing of ignition is important, and in both cases ignition timing is varied in accordance with engine speed. In the present application, however, the discussion will be limited to a four-stroke cycle internal combustion gasoline engine by way of example.

Returning now to FIG. 1 of the drawings, there is a tachometer 12 of substantially conventional design, the tachometer 12 providing an input to the means for detecting changes in engine speed, or engine r.p.m., here designated as a change in r.p.m. detector 14. When a change in r.p.m. is detected, a servo motor 15 is operated to make the proper adjustment in the distributor 11 to change the ignition timing of the engine 10.

It should now be understood generally that a tachometer 12 indicates the engine r.p.m.; and, as long as the r.p.m. is constant there is no effect in the apparatus of the present invention. However, when there is a change in the engine r.p.m., that change is detected by the detector 14 and the detector 14 causes the servo motor 15 to operate to vary the timing. Once the timing is reset, there will be no further function of the apparatus of the present invention until there is another change in engine r.p.m.

With this general understanding, attention is now directed to FIGS. 2 and 3 of the drawings which show a meter 16 secured to the top 18 of a housing 19. The meter 16 constitutes the indicator of the tachometer 12 so that the position of the hand 20 of the meter 16 is always a function of the engine r.p.m. The end of the hand 20 of the meter 16 is provided with a gate 21 which will be discussed more fully hereinafter.

Adjacent to the meter 16 and disposed parallel thereto, there is a turntable 22. The turntable 22 is carried on a shaft 24 which is journaled in the bottom 25 of the housing 19 and in the intermediate wall 26. Appropriate bearings 28 and 29 allow free rotation of the shaft 24 without any appreciable movement in any other direction.

Between the wall 26 and the bottom, the shaft 24 mounts a worm gear 30 and a pulley 31. A worm 32 is carried on a worm shaft 34, the shaft 34 being appropriately journaled in the sides 35 and 36 of the housing 19. The worm shaft 34 is arranged to be driven by the servo motor 15 which is secured to the side 35 of the housing.

Mounted on the turntable 22, it will be seen in FIG. 3 that there is a wall 40 arranged arcuately so that the center of the arc of the wall 40 is the pivot point of the hand 20 of the meter 16, which is also the center of the turntable 22. The wall 40 has two openings 41 and 42 therein, and these two openings 41 and 42 can be selectively closed by the gate 21 as will be better understood hereinafter.

Inwardly of the wall 40, towards the center of the turntable 22, there is a pair of light sources 44 and 45, the light source 44 being arranged to direct a beam of light through the opening 41 of the wall 40 and the light source 45 being arranged to direct a beam of light through the opening 42 in the wall 40.

Opposite the opening 41 in the wall 40, and radially outwardly of the light source 44, there is a photoelectric cell 46 which is arranged to receive the beam of light from the light source 44. Similarly, there is a photoelectric cell 48 opposite the opening 42 in the wall 40, the cell 48 being radially outwardly of the light source 45 and arranged to receive the beam of light from the light source 45.

With the above discussion in mind, it will be seen that, with a constant engine r.p.m. the hand 20 of the meter 16 will remain between the openings 41 and 42 as shown in FIG. 3 of the drawings so light from the light sources 44 and 45 falls on the photoelectric cells 46 and 48. But, when there is a change in the engine r.p.m., the hand 20 of the meter 6 will move to reflect that change, and movement of the hand 20 will cause the gate 21 to cover (for example) the opening 41 in the wall 40. As will be discussed hereinafter, the blocking of light to the photoelectric cell 46 will cause the servo motor 15 to be operated which will rotate the worm 32, hence the worm gear 30. Rotation of the worm gear 30 and its shaft 24 will rotate the turntable 22 to move the wall 40 until the gate 21 is again between the two openings 41 and 42. Also, rotation of the shaft 24 will rotate the pulley 31 to manipulate the cable 49, and the cable 49 is used to change the timing of the engine 10.

Attention is now directed to FIG. 4 of the drawings which shows a distributor 11 adapted for use with the apparatus of the present invention. In general terms, the distributor 11 includes a housing 50 having a cap 51 and a contact plate 52. The distributor cap 51, as is conventional, includes a centrally disposed jack 54 to receive the high voltage line from the spark coil, and a plurality of jacks 55 for receiving the leads that connect from the distributor 11 to the individual spark plugs (not shown). As is conventional also, the distributor 11 includes a cam 56 carried by the distributor drive shaft, and a cam follower 58 for closing electrical contacts, or points, 59. In the usual arrangement, the cam 56 is rotated with respect to the housing 50 in response to changes in rotational speed of the distributor drive shaft through centrifugal means.

In the present arrangement as shown in FIG. 4, the housing 50 is generally stationary with respect to the engine, and the contact plate 52 comprises the bottom of an inner cup-like structure having a cylindrical side wall 60. When the ignition timing is to be varied in response to a change in engine r.p.m., the contact plate 52 is rotated by means of the cable 49.

In more detail, there is an upstanding pin 61 fixed to the contact plate 52, and an adjusting arm 62 is pivotally carried by the pin 61 and extends out, through an appropriate slot 64 in the wall 60, and into a cable run 65. The cable run 65 has a spring 66 fixed at one end with the cable 49 fixed to the opposite end of the spring 66. The cable 49 passes through the adjusting arm 62 and is fixed thereto, then continues in the cable run 65 to an exit 68.

Inwardly of the wall 60, there is a pair of opposed solenoids 69 and 70 mounted on the contact plate 52, each of the solenoids 69 and 70 having its plunger pivotally fixed to the adjusting arm 62.

In the course of operation, the entire inner structure must rotate; thus, the jacks 55 have spring urged brushes 71 electrically connected to the jack, each of the brushes 71 riding on a segment 72. The segments 72 are of sufficient length to allow the brush 71 to remain in contact throughout the maximum operating limits. If desired, the rotor 73 may include a spring urged brush 74 for making sliding contact with the various contacts around the distributor.

Figure 6:
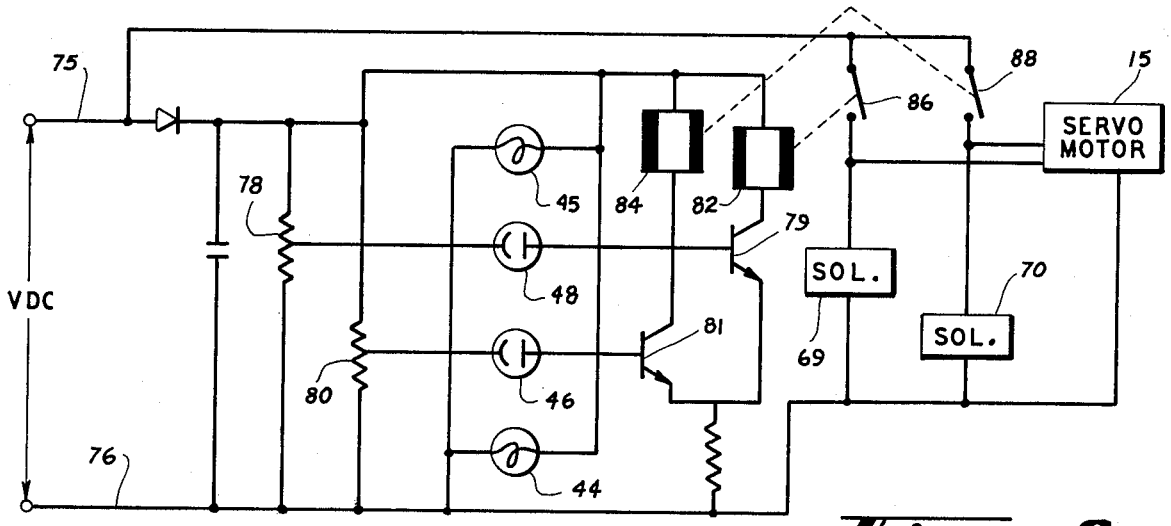

For a better understanding of the electrical controls involved in the apparatus of the present invention, attention is directed to FIG. 6 of the drawings. Here it will be seen that the automobile battery or the like will provide a voltage on the two leads 75 and 76. The resistor of a potentiometer 78 is connected between the leads 75 and 76, and the movable contact is connected to the photoelectric cell 48. The light source 45 is appropriately connected so that the light 45 will be "on" as long as power is available on the leads 75 and 76. Thus, as long as light from the light source 45 falls on the photoelectric cell 48, a cut-off voltage will be placed on the base of a transistor 79.

Similarly, there is a potentiometer 80 having its resistor connected between the leads 75 and 76 and the movable contact connected to the base of a transistor 81. The light source 44 is connected across the power source to be constantly illuminated.

When light to one of the photoelectric cells 46 or 48 is blocked, there is no longer a voltage supplied to the base of the transistor 79 or 81, so a current will flow from the line 75, through the relay 82 or 84, through the emitter-collector circuit of the transistor 79 or 81 and through a resistor 85 to the lead 76. When a relay 82 or 84 is energized, a switch 86 or 88 will be closed to energize the servo motor 15 and one of the solenoids 69 and 70.

Since the control circuit as a whole is substantially conventional in design, no further discussion is thought to be necessary.

With the foregoing description in mind, the operation of the device should now be understandable. Considering first that the engine 10 is operating at a constant r.p.m., it will be understood that the hand 20 of the meter 16 will remain steady, and the gate 21 will remain between the two openings 41 and 42. As a result, light will fall on both the photoelectric cells 46 and 48 to bias the transistors 79 and 81 to prevent current flow. However, if the engine r.p.m. changes somewhat, the meter 16 will detect the signal from the tachometer circuit 12 and the hand 20 will move and (for example) will block the opening 41 to block the light from the light source 44. When light no longer falls on the photoelectric cell 46, the transistor 81 will lose its blocking voltage and a current can flow through the emitter-collector circuit. Thus, current will flow through the coil of the relay 84 and close the switch 88. This will result in energization of the servo motor 15 and the solenoid 70.

Looking at FIG. 4, it will be understood that, when the solenoid 70 is energized, the adjusting arm 62 will pivot about the pin 61. Since the cable 49 is generally stationary with respect to the distributor, and the pin 61 is stationary with respect to the contact plate 52, the only possible motion is for the solenoid 70 to move towards the adjusting arm 62; and, since the solenoid 70 is fixed to the contact plate 52, the contact plate 52 will be rotated. Because there is necessarily some delay in operations of the remainder of the system, the operation of the solenoid 70 (or the solenoid 69) compensates and brings the system to the desired point.

It will be remembered that, at the same time the solenoid 70 was energized, the servo motor 15 was energized, so the worm 32 began to rotate, to rotate the worm gear 30 and the pulley 31. As was discussed hereinabove, rotation of the worm gear 30 also causes rotation of the turntable 22 until the wall 40 is once again positioned with the gate 21 between the two openings 41 and 42. Also, however, rotation of the pulley 31 causes motion of the cable 49.

Considering now the distributor 11 as shown in FIG. 4 of the drawings, it will be understood that, as the cable 49 is pulled by being taken up on the pulley 31, the cable 49 will be moved in the cable run 65, stretching the spring 66, and moving the end of the adjusting arm 62.

Since the arm 62 cannot move with respect to the contact plate 52, the entire plate 52 is caused to rotate. It should be noted that the motion of the cable 49 moves the contact plate 52 further in the same direction the plate 52 was moved by the solenoid 70.

Those skilled in the art will equally well understand that, if the hand 20 of the meter 16 moves in the opposite direction, all the above described actions will take place in the opposite direction, and the spring 66 will take up cable 49 unwound from the pulley 31 but the operation will be the same. Moreover, it will be seen that a too-rapid motion of the hand 20 could allow the hand 20 to move beyond the wall 40 so that both light beams would be uncovered, thereby stopping rotation of the turntable 22. To prevent such a condition, the two extreme ends of the wall 40 can be turned inwardly as at 43 so the gate 21 is physically restrained from motion beyond the wall 40.

It will of course be understood that the particular embodiment of the invention here shown is by way of illustration only and is meant to be in no way restrictive; therefore numerous changes and modifications may be made, and the full use of equivalents resorted to, without departing from the spirit or scope of the invention as defined by the appended claims.

I claim:

1. Timing control apparatus for an engine including a tachometer for determining the engine r.p.m., said tachometer including a meter having a hand, a gate carried by said hand, a turntable generally parallel to the plane of motion of said hand, a light source mounted on said turntable on one side of said gate, a photoelectric cell mounted on said turntable on the opposite side of said gate, the arrangement being such that a light beam passes from said light source to said photoelectric cell, said hand being movable in response to a change in engine r.p.m., movement of said hand causing said gate to break said light beam, a servo unit for changing the ignition timing of said engine, and circuit means responsive to the breaking of said light beam for operating said servo unit, said turntable being rotatable by said servo unit, a wall mounted on said turntable, said wall defining two openings therein closable by said gate, the apparatus being so constructed and arranged that motion of said gate in one direction causes said gate to block one of said openings, and motion of said gate in the opposite direction causes said gate to block the other of said openings, said light source being adjacent to one of said openings, said photoelectric cell being on the other side of said wall for receiving light from said light source, a second light source adjacent to said other of said openings, and a second photoelectric cell being on the other side of said wall for receiving light from said second light source, the arrangement being such that motion of said hand in one direction causes said gate to block said one opening and motion of said hand in the opposite direction causes said gate to block said other opening.

2. Timing control apparatus as claimed in claim 1, said servo unit including a shaft carrying said turntable, a gear fixed to said shaft, a motor, said gear being rotatable by said motor, a pulley fixed to said shaft, and a cable trained over said pulley for changing the ignition timing of said engine.

3. Timing control apparatus as claimed in claim 2, said engine including a distributor, points in said distributor, and a cam for operating said points, a contact plate within said distributor, said contact plate carrying said points and being rotatable with respect to said cam, an adjusting arm carried by said contact plate, said cable being fixed to said adjusting arm for rotating said contact plate in response to motion of said cable.

4. Timing control apparatus as claimed in claim 3, said adjusting arm being pivotally fixed to said contact plate, and further including opposed solenoids, said solenoids being fixed to said contact plate, the plungers of said solenoids being fixed to said adjusting arm, and circuit means for energizing one of said solenoids simultaneously with operation of said motor.

5. Timing control apparatus for an engine including a tachometer for determining the engine r.p.m., said tachometer including a meter having a hand, a gate carried by said hand and movable therewith, a turntable adjacent to said meter and in a plane substantially parallel to the plane of motion of said hand, said turntable having an axis of rotation substantially aligned with the axis of rotation of said hand, a servo unit, drive means drivingly connecting said servo unit to said turntable so that operation of said servo unit causes rotation of said turntable, remote operating means for controlling the timing of said engine by said servo unit so that operation of said servo unit varies the timing of said engine, a pair of radiant energy propagating means mounted on said turntable and movable therewith, a pair of radiant energy sensitive means mounted on said turntable for receiving energy from said energy propagating means, circuit means electrically connected to said energy sensitive means and to said servo unit, said gate being disposable between one of said energy propagating means and one of said energy sensitive means for blocking energy to said one of said energy sensitive means on an increase in said engine r.p.m. and disposable between the other of said energy propagating means and said other energy sensitive means on a decrease in engine r.p.m., said gate being removed from between said energy propagating means and said energy sensitive means by rotation of said turntable, said circuit means being so constructed and arranged that the blocking of energy to said energy sensitive means causes operation of said servo unit and the allowing of said energy sensitive means to receive energy ceases operation of said servo unit.

* * * * *

UNITED STATES PATENT AND TRADEMARK OFFICE

CERTIFICATE OF CORRECTION

PATENT NO. : 4,080,939

DATED : March 28, 1978

INVENTOR(S) : Bobby J. C. Love

It is certified that error appears in the above-identified patent and that said Letters Patent are hereby corrected as shown below:

The name of the Inventor should be:

Curtis Bobby Jene Love.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*